US008840443B2

(12) United States Patent
Kadium

(10) Patent No.: US 8,840,443 B2
(45) Date of Patent: Sep. 23, 2014

(54) GARMENTS FOR POST MASTECTOMY SURGERY

(76) Inventor: Tara Sand Kadium, Thousand Oaks, CA (US)

( * ) Notice: Subject to any disclaimer, the term of this patent is extended or adjusted under 35 U.S.C. 154(b) by 477 days.

(21) Appl. No.: 13/181,057

(22) Filed: Jul. 12, 2011

(65) Prior Publication Data

US 2013/0017760 A1 Jan. 17, 2013

(51) Int. Cl.

| | |
|---|---|
| ***A41C 3/00*** | (2006.01) |
| ***A41D 13/12*** | (2006.01) |
| ***A41C 3/14*** | (2006.01) |
| *A41D 1/22* | (2006.01) |

(52) U.S. Cl.

CPC ..... *A41D 13/1245* (2013.01); *A41C 3/148* (2013.01); *A41D 1/22* (2013.01)

USPC ..... 450/58; 450/79

(58) Field of Classification Search

USPC ..... 450/15–17, 30, 31, 27, 28, 58, 79; 2/104, 106, 96, 114, 102, 109, 110

See application file for complete search history.

(56) References Cited

U.S. PATENT DOCUMENTS

| | | | | |
|---|---|---|---|---|
| 1,288,927 | A * | 12/1918 | Kops | 450/79 |
| 1,417,930 | A | 5/1922 | Mailleue et al. | |
| 3,040,750 | A * | 6/1962 | Hurwitz | 450/58 |
| 3,094,125 | A | 6/1963 | Lewis et al. | |
| 3,508,555 | A * | 4/1970 | Bogdon | 450/3 |
| 3,826,266 | A * | 7/1974 | Alpert | 450/11 |
| 4,185,332 | A | 1/1980 | Jahnig | |
| 5,257,956 | A * | 11/1993 | Ewen | 450/1 |
| 6,032,289 | A * | 3/2000 | Villapiano | 2/102 |
| 6,048,252 | A * | 4/2000 | Sebring | 450/1 |
| 6,220,924 | B1 | 4/2001 | Kobayashi et al. | |
| 6,390,885 | B1 * | 5/2002 | Brooks | 450/1 |
| 6,402,586 | B1 | 6/2002 | Winik et al. | |
| 6,574,800 | B1 * | 6/2003 | Leger et al. | 2/114 |
| 6,604,983 | B1 | 8/2003 | Denn | |
| 6,860,789 | B2 * | 3/2005 | Bell et al. | 450/20 |
| 7,144,294 | B2 * | 12/2006 | Bell et al. | 450/20 |
| 7,258,593 | B2 * | 8/2007 | Mineconzo | 450/1 |
| 7,293,295 | B2 * | 11/2007 | King | 2/114 |
| 7,396,272 | B1 * | 7/2008 | Newlen | 450/54 |
| 7,549,971 | B2 * | 6/2009 | Bell et al. | 602/75 |
| D627,948 | S | 11/2010 | Astrom | |
| 2002/0102913 | A1 * | 8/2002 | Courtney et al. | 450/57 |
| 2004/0002288 | A1 * | 1/2004 | Bell et al. | 450/75 |
| 2005/0009445 | A1 * | 1/2005 | Bell et al. | 450/1 |
| 2005/0112996 | A1 * | 5/2005 | Buehler | 450/58 |
| 2006/0019576 | A1 * | 1/2006 | Bell et al. | 450/60 |
| 2006/0173427 | A1 * | 8/2006 | Urbina et al. | 604/327 |
| 2008/0113587 | A1 * | 5/2008 | Richardson | 450/58 |

* cited by examiner

*Primary Examiner* — Gloria Hale
(74) *Attorney, Agent, or Firm* — Cislo & Thomas, LLP

(57) ABSTRACT

A garment for a post mastectomy surgery woman comprises a waistband fits about a waist of the woman. A strap is joined to the waistband to extend from the waistband at a side of the woman's surgery, up over a shoulder on a side opposite the surgery and down to the waistband on the surgery side. A bra cup is configured to fit about the woman's healthy breast. A first strap is configured to laterally join a first side of the bra cup to the strap on the woman's front. A second strap is configured to laterally join a second side of the bra cup to the strap on the woman's back. An elastic paneling is configured to join to the strap, the bottom side of the bra cup, the first strap, the second strap, and the waistband. The elastic paneling positions the bra cup to support the woman's healthy breast.

11 Claims, 3 Drawing Sheets

GARMENTS FOR POST MASTECTOMY SURGERY

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to female undergarments for post mastectomy wear. More particularly, the invention relates to single sided breast support and achieving a symmetrical breast appearance.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

A mastectomy is a surgical procedure that involves the removal of a breast, with a subsequent asymmetrical appearance. Following mastectomy, a regular bra cannot be worn due to tenderness, as it constricts the surgical area and interferes with drainage tubing from the surgical area. This leaves the healthy breast unsupported. Current mastectomy camisoles available cannot be worn for about six weeks, and provide no support to the remaining breast. Mastectomy bras with prostheses cannot be worn until healing is complete, after more than two months.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1A is a diagrammatic front view, and FIG. 1B is a diagrammatic rear view.

FIG. 2A is a diagrammatic front view. FIG. 2B is a partially transparent rear view, and FIG. 2C is a diagrammatic side view.

Figure 1B:
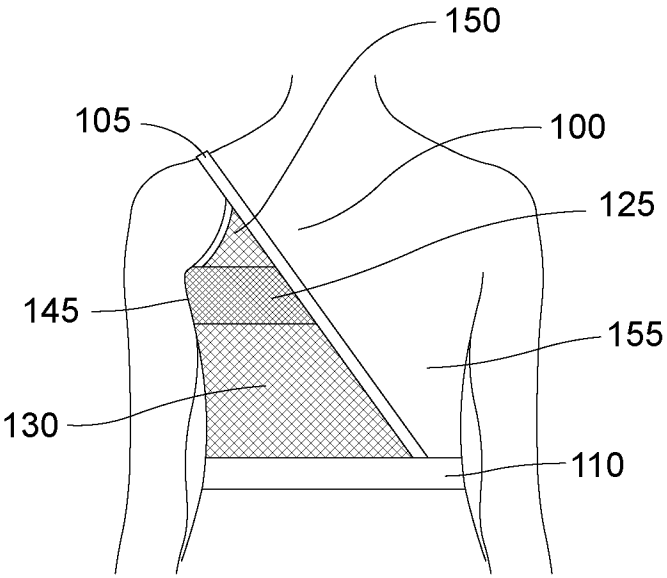
FIGS. 1A and 1B illustrate an exemplary single cup bra, in accordance with an embodiment of the present invention.

Unless otherwise indicated illustrations in the figures are not necessarily drawn to scale.

SUMMARY OF THE INVENTION

To achieve the forgoing and other objects and in accordance with the purpose of the invention, a variety of specialized undergarments for post mastectomy surgery is described.

In one embodiment, the garment for post mastectomy surgery comprises a waistband configured to fit about a waist of the woman. A strap is joined to the waistband and is configured to extend diagonally from the waistband below the site of the mastectomy, up over a shoulder to the side opposite the surgery, and down to the waistband on the surgery side in the back. A bra cup comprises a first side, a bottom side, and a second side, configured to fit about the woman's remaining breast. A first strap is configured to laterally join the first side of the bra cup to the strap on the woman's front. A second strap is configured to laterally join the second side of the bra cup to the strap on the woman's back. An elastic panel is configured to join to the strap, the bottom side of the bra cup, the first diagonal strap, the second lateral strap, and the waistband where the elastic paneling positions the bra cup to support the remaining breast. Another embodiment further comprises a panel being configured to join to the strap, the top of the bra cup, the first strap and the second strap. In yet another embodiment the second lateral strap further comprises a rib support for mitigating curling or bunching of that strap. In still another embodiment the strap comprises a mechanism joined to the strap near the shoulder. The mechanism is configured to adjust a length of the shoulder strap. In another embodiment the mechanism is further configured to separate the strap into two pieces. In yet another embodiment the waistband is further configured to be adjustable. Still another embodiment further comprises a camisole being configured to be draped over at least the waistband, the strap, the bra cup, the first strap, the second strap and the elastic panel. In another embodiment the camisole comprises a front and a back. The back comprises a back panel. The front comprises two front panels being joined to the back panel. In yet another embodiment each front panel comprises one breast pocket being configured to accept insertion of a breast form above a site of the surgery. In still another embodiment each front panel also comprises at least one pocket being configured to be operable to hold surgical drainage tubes. In another embodiment the front panel comprises, a first front panel and a second front panel being removably joined together to open the front panel.

In another embodiment garment for post mastectomy surgery comprises means for securing a piece of the garment about a waist of the woman, means for supporting the piece of the garment on a shoulder on a side opposite the surgery, means for fitting about the remaining breast, means for laterally joining the fitting means to the supporting means, means for elastically joining the securing means, the supporting means, the fitting means and the laterally joining means to position the fitting means to support the remaining breast, and means for draping over the securing means, the supporting means, the fitting means, the laterally joining means and the elastically joining means. Another embodiment further comprises means for supporting a breast form above a site of the surgery. Yet another embodiment further comprises means for holding surgical drainage tubes.

In another embodiment a camisole for post mastectomy surgery comprises a back comprising a back panel. A front comprises left and right front panels being joined to the back panel. One e breast pocket is joined to each front panel. Each breast pocket is configured to accept insertion of a breast form above a site of the surgery. Another pocket on each panel is configured to be operable to hold surgical drainage tubes. In another embodiment each breast pocket is disposed on an inside portion of the front panel. In still another embodiment the front panel comprises a first front panel and a second front panel being removably joined together to open or close the front panels. In another embodiment the front comprises a V-shaped neckline. In yet another embodiment the back comprises a V-shaped neckline.

Other features, advantages, and objects of the present invention will become more apparent and be more readily understood from the following detailed description, which should be read in conjunction with the accompanying drawings.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

A practical embodiment of the present invention provides single sided breast support for women post mastectomy that can be worn immediately after surgery. Many practical embodiments also comprise a camisole overlay with pockets for breast forms to replace an absent breast. Many practical embodiments provide support to the healthy breast after surgery and do not constrict the surgical area. Also, these embodiments are easy to put on unlike current mastectomy camisoles that are often snug on the body and may need to be put on or taken off over the head. Traditional camisoles usually cause overheating of the body, particularly with menopausal women.

Figure 1A:
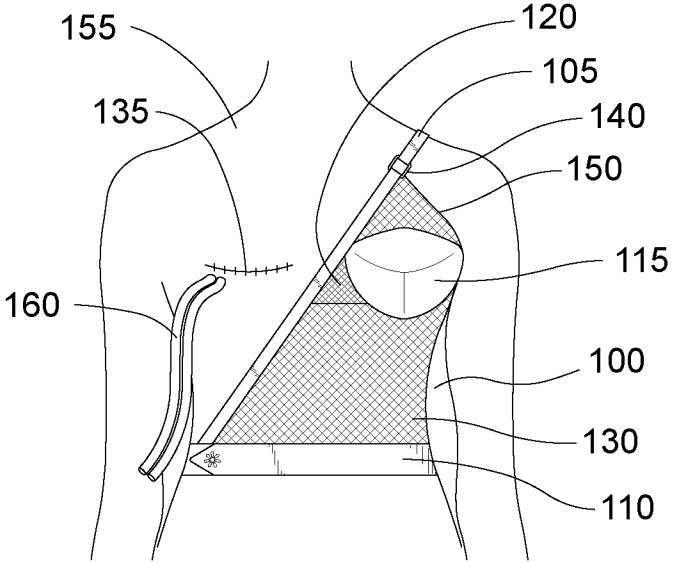

FIGS. 1A and 1B illustrate an exemplary single cup bra 100, in accordance with an embodiment of the present invention. FIG. 1A is a diagrammatic front view, and FIG. 1B is a diagrammatic rear view. In the present embodiment, bra 100 comprises a diagonal strap 105 extending from a waistband 110 in front, over the shoulder and to waistband 110 in back. A single bra cup 115 is connected to the front of strap 105 by a connecting band 120 and to the back of strap 105 by a connecting band 125. Elastic paneling 130 connects bra cup 115 and connecting band 120 to waistband 110 in front and back to stabilize cup 115 and generally prevent shifting.

The design of strap 105, which extends from the side of the mid abdomen in front below a surgical site 135 up to the shoulder of the non-affected side, enables bra 100 to be worn after surgery since surgical site 135 is typically not touched. Strap 105 is adjustable and opens and closes with a sliding clasp 140 near the shoulder. Some alternate embodiments may use a multiplicity of suitable fastening means such as, but not limited to, snaps, hooks, hook and loop material etc. In other alternate embodiments, the strap may not be adjustable or may not be able to be fastened or unfastened. In the present embodiment, waistband 110 is adjustable and located near the lower mid abdomen to stabilize bra 100 and generally prevent riding up. Waistband 110 may comprise various different means for adjustable closure such as, but not limited to, hook and loop material, buckles, hooks and eyes, sliding clasps, etc. Some alternate embodiments may comprise separate means for adjusting the belt and fastening the belt. In the present embodiment, waistband 110 is approximately one inch wide and diagonal strap 105 is approximately ½ inch wide; however, the waistbands and straps in alternate embodiments may be narrower or wider. In some alternate embodiments, an additional strap may be added that connects to the mid portion of the back of the diagonal strap and crosses over the shoulder on the surgical side to connect to the upper third of the front of the diagonal strap. This embodiment creates a V-design near the neck in the front and back and may provide additional support.

In the present embodiment, connecting bands 120 and 125 connect cup 115 to diagonal strap 105 for greater stability. Those skilled in the art, in light of the teachings of the present invention will readily recognize that a multiplicity of suitable materials may be used for connecting bands 120 and 125 such as, but not limited to mesh, elastic banding, fabric, etc. In the present embodiment, connecting band 125 comprises a rib support 145 to generally prevent curling or bunching of connecting band 125. However, this rib support may be omitted in some alternate embodiments. In the present embodiment, a panel 150 connects the top of cup 115 and the top of connecting band 125 to diagonal band 105. Panel 150 may be made of various different materials such as, but not limited to, elastic mesh, cotton, lace, elastic fabrics, etc. Some alternate embodiments may be implemented without this panel. In the present embodiment, bra cup 115 is typically made of standard fabrics and lingerie materials currently available and may or may not comprise an under wire. Paneling 130 may be made of various different materials such as, but not limited to, elastic mesh, lace, cotton, etc. Some alternate embodiments may be implemented without paneling below the bra cup extending around the body to the diagonal strap in back. Those skilled in the art, in light of the teachings of the present invention, will readily recognize that a multiplicity of suitable trims and decorations may be included, without limitation, on some embodiments. For example, without limitation, elastic lace covering may be placed on the diagonal strap in front and back, decorative buttons or snaps may be used for the fasteners, a design may be placed on the waistband near the closure with a monogram or embellishment, etc.

In typical use of the present embodiment, bra 100 is worn around the waist and the non-affected shoulder of a user 155. The adjustable diagonal design from above the hip to the opposite shoulder and diagonally down to the lower back allows for post-surgical drainage tubes 160 and surgery site 135 to be unaffected while providing support to the remaining healthy breast.

Figure 2B:
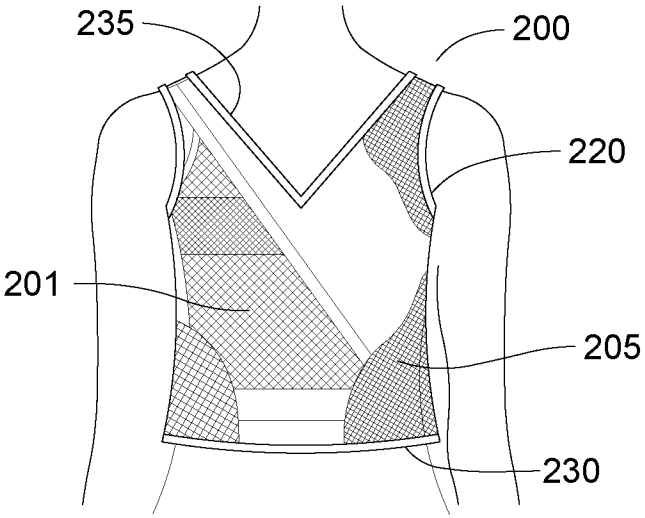
FIGS. 2A through 2C illustrate an exemplary camisole, in accordance with an embodiment of the present invention.
Figure 2A:
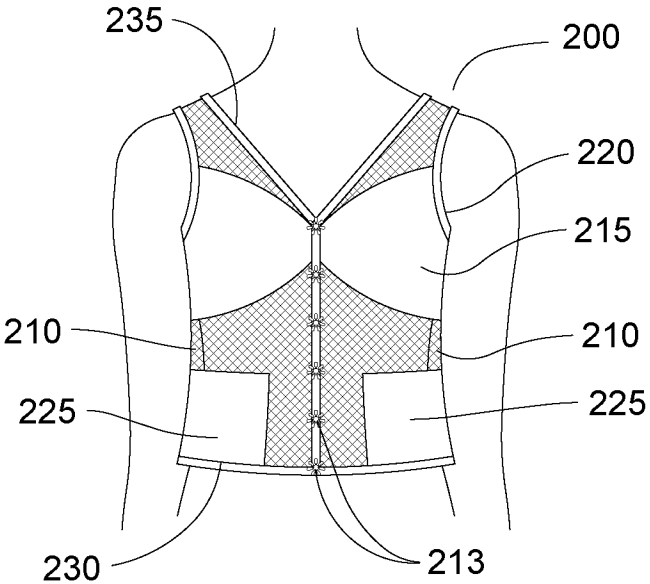
Figure 2C:
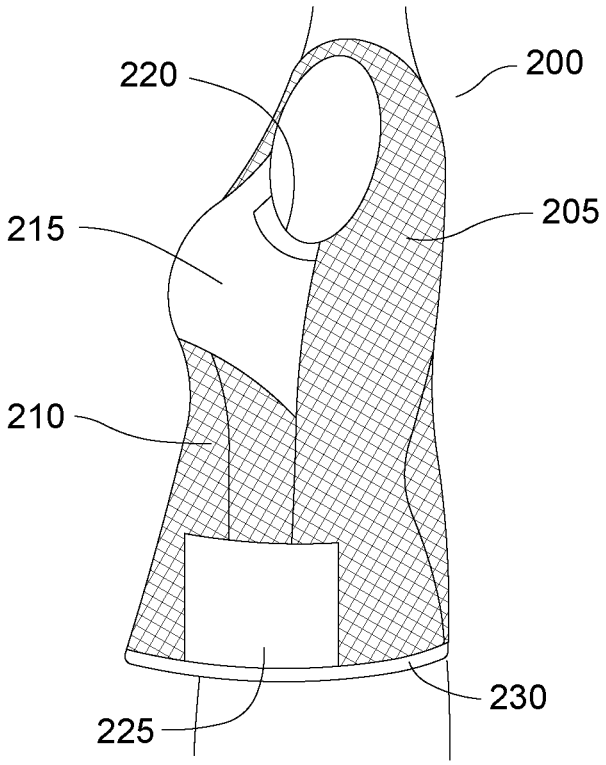

FIGS. 2A through 2C illustrate an exemplary camisole 200, in accordance with an embodiment of the present invention. FIG. 2A is a diagrammatic front view. FIG. 2B is a partially transparent rear view, and FIG. 2C is a diagrammatic side view. In the present embodiment, camisole 200 is a sleeveless garment comprising a large back panel 205 and two front panels 210 each stitched to back panel 205 at the sides. Panels 205 and 210 are made of a lightweight, breathable, typically sheer material such as, but not limited to, open mesh fabric or lace. However, various different materials may be used such as, but not limited to, cotton, satin, silk, blends, etc. Camisole 200 opens and closes at the front with fastening means 213 such as, but not limited to, snaps, hooks, buttons, hook and loop material, etc. An opaque area 215 over the bust comprises hidden pockets 220 on the inside of camisole 200 into which breast forms may be inserted. In some alternate embodiments, this area may be sheer rather than opaque. In other alternate embodiments, the entire camisole may be opaque. In the present embodiment, two pockets 225 located on the inside of camisole 200 near the side seams can be used to hold and conceal drainage tubes and containers near the waist area. In addition, drainage tubes may be pinned to a fabric edging 230 around the bottom of camisole 200. In some alternate embodiments, the pockets may be placed on the front of the camisole instead of the sides. In other alternate embodiments, the pockets may be placed on the outside of the camisole. Other alternate embodiments may comprise more or fewer pockets. Yet other alternate embodiments may be implemented without pockets for drainage tubes. Furthermore, some alternate embodiments may be implemented without a fabric edging around the bottom. In the present embodiment camisole 200 comprises a V-shaped neckline 235 in the front and back; however, some alternate embodiments may have necklines of various different shapes including, without limitation, a modified to scoop neck, a front V-neck only, a square neck, etc. It is contemplated that some embodiments of the present invention may comprise a multiplicity of suitable trim or details for decoration such as, but not limited to, lace edgings, decorative buttons or snaps, ribbons, panels of fabrics added to the back and front, etc.

In typical use of the present embodiment, camisole 200 is worn over a single cup bra 201. Together, single cup bra 201, camisole 200 and a breast form inserted into a pocket 220 can achieve a comfortable, symmetrical look, without interfering with sutures, drains or healing. The breathable fabric allows for air circulation to keep the user cool and to support healing. Additionally, V-shaped neckline 235 minimizes surface area contact with the skin. Frontal access and closure generally makes putting on and taking off camisole 200 easy. The loose fit of camisole 200 generally ensures that there is no constriction or pressure near tender areas or drainage tubes so that camisole 200 can be worn immediately following surgery. Furthermore, camisole 200 can be worn with a breast insert and without a bra, for example, without limitation, at night under a nightgown, to achieve symmetry. Camisole 200 may also be worn with or without a bra and without a breast insert.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Having fully described at least one embodiment of the present invention, other equivalent or alternative methods of providing single breast support according to the present invention will be apparent to those skilled in the art. The invention has been described above by way of illustration, and the specific embodiments disclosed are not intended to limit the invention to the particular forms disclosed. For example, the particular implementation of the bra may vary depending upon the particular type of camisole used. The camisoles described in the foregoing were directed to separate overlay implementations; however, similar techniques are to provide camisoles that are permanently attached to the bra or may be removably attached to the bra by various different means including, without limitation, hooks, snaps, hook and loop material, etc. Connected implementations of the present invention are contemplated as within the scope of the present invention. The invention is thus to cover all modifications, equivalents, and alternatives falling within the spirit and scope of the following claims.

Claim elements and steps herein may have been numbered and/or lettered solely as an aid in readability and understanding. Any such numbering and lettering in itself is not intended to and should not be taken to indicate the ordering of elements and/or steps in the claims.

What is claimed is:

1. A post-surgical garment for a woman having a breast surgery site on a first side of a sagittal plane of the woman's body and a breast on a second side of the sagittal plane of the woman's body, the garment comprising:

a waistband being configured to fit about a waist of the woman;

a strap being joined to said waistband and being configured to extend from said waistband at the first side of the woman's body, up over a shoulder on the second side of the woman's body and down to said waistband on the first side of the woman's body;

a bra cup comprising a first side, a bottom side, and a second side, said bra cup being configured to fit about the woman's breast on the second side of the woman's body;

a first connecting band being configured to laterally join said first side of said bra cup to said strap a front side of the woman;

a second connecting band being configured to laterally join said second side of said bra cup to said strap a back side of the woman; and an elastic paneling being configured to join to said strap, said bottom side of said bra cup, said first connecting band, said second connecting band, and said waistband where said elastic paneling positions said bra cup to support the woman's breast on the second side of the woman's body.

2. The garment as recited in claim 1, further comprising a panel being configured to join to said strap, said top of said bra cup, said first connecting band and said second connecting band.

3. The garment as recited in claim 1, in which said second connecting band further comprises a rib support for mitigating curling of said second connecting band.

4. The garment as recited in claim 1, in which said strap comprises a mechanism joined to said strap near the shoulder, said mechanism being configured to adjust a length of said strap.

5. The garment as recited in claim 4, in which said mechanism is further configured to separate said strap into two pieces.

6. The garment as recited in claim 1, in which said waistband is further configured to be adjustable.

7. The garment as recited in claim 1, further comprising a camisole being configured to be draped over at least said waistband, said strap, said bra cup, said first connecting band, said second connecting band and said elastic panel.

8. The garment as recited in claim 7, in which said camisole comprises a front and a back, said back comprising a back panel, said front comprising a front panel being joined to said back panel.

9. The garment as recited in claim 8, in which said front panel comprises at least one breast pocket being configured to accept insertion of a breast form above a site of the surgery.

10. The garment as recited in claim 8, in which said front panel comprises at least one pocket being configured to be operable to hold surgical drainage tubes.

11. The garment as recited in claim 8, in which said front panel comprises, a first front panel and a second front panel being removably joined together to be operable to open and/or close said front panel.

* * * * *